US005152476A

United States Patent [19]

Moser

[11] Patent Number: 5,152,476

[45] Date of Patent: Oct. 6, 1992

[54] BEND REDUCING FEED IN FOR FILAMENT PAYOUT TUBES

[75] Inventor: Karen K. Moser, Omaha, Nebr.

[73] Assignee: AT&T Bell Laboratories, Murray Hill, N.J.

[21] Appl. No.: 722,733

[22] Filed: Jun. 27, 1991

[51] Int. Cl.[5] ..... B65H 57/12; B65H 57/18; B65H 55/00; B65H 49/08

[52] U.S. Cl. ..... 242/157 R; 242/137.1; 242/163; 242/171

[58] Field of Search ..... 242/157 R, 137.1, 163, 242/171, 132, 140, 146, 170, 172

[56] References Cited

U.S. PATENT DOCUMENTS

| | | | |
|---|---|---|---|
| 2,634,922 | 4/1953 | Taylor, Jr. | 242/163 |
| 3,655,140 | 4/1972 | Gordon et al. | 242/163 |
| 3,985,315 | 10/1976 | Newman | 242/163 |
| 4,009,845 | 3/1977 | Santucci et al. | 242/137.1 X |
| 4,022,399 | 5/1977 | Zajac | 242/163 |
| 4,057,203 | 11/1977 | Newman et al. | 242/163 |
| 4,057,204 | 11/1977 | Zajac | 242/163 |
| 4,160,533 | 7/1979 | Kotzur et al. | 242/137.1 |
| 4,274,607 | 6/1981 | Priest | 242/163 |
| 4,373,687 | 2/1983 | Zicko | 242/163 |
| 5,042,739 | 8/1991 | Zajac | 242/157 R |
| 5,064,136 | 11/1991 | Hunt | 242/157 R |

*Primary Examiner*—Stanley N. Gilreath
*Attorney, Agent, or Firm*—R. F. Kip, Jr.

[57] ABSTRACT

An improvement is disclosed for payout tubes secured within a container for a coil of cable therein so that the tube projects at its exit end through a hole in a wall of the container. The tube is adapted to dispense cable fed into its entrance end from inside to outside the container. The improvement is, broadly, providing at such entrance end a curved cable support surface extending around the tube of large enough radius of curvature to prevent deformation in cable, fed in contact with the surface into the tube, of tight bends causing kinking of and damage to the cable. Such surface may be provided either on a cap in turn fittable onto the tube at its entrance end or, alternatively, directly on the tube at that end.

12 Claims, 6 Drawing Sheets another embodiment of the invention, such device may be a complete payout tube which is configured at its back end to provide there a curved cable support surface area of the kind described above.

BRIEF DESCRIPTION OF THE DRAWING

For a better understanding of the invention, reference is made to the following description of exemplary embodiments thereof, and to the accompanying drawings wherein.

DETAILED DESCRIPTION

Figure 1:
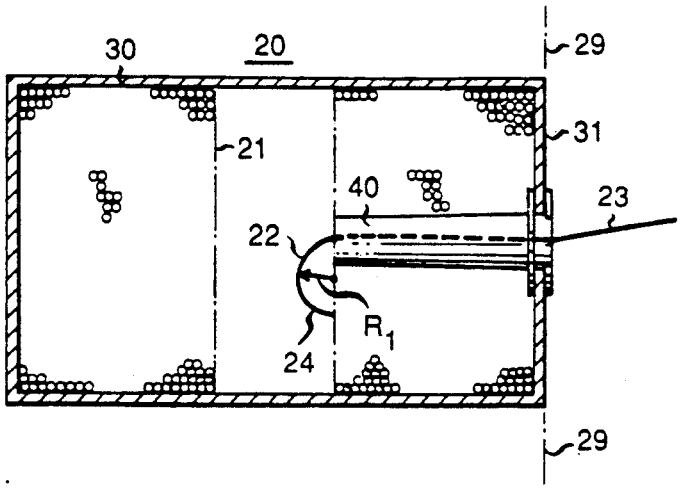
FIG. 1 is a schematic front elevational view, partly in cross-section, of the assemblage of a coil of cable, a container in which such coil is packaged, and payout tube disposed in the container for dispensing from the container the cable payed out from the coil, such tube being adapted to have fitted thereon a cable bend reducing cap according to the invention.

Referring now to FIG. 1, the reference number 20 designates an assembly of a coil 21 of a cable 22 packaged in a container 30 in which is a payout tube 40 for dispensing lengths of such cable from the container. A length 23 of such cable is shown as extending from coil 21 through tube 40 to the outside of container 30. Such cable length 23 passing from coil 21 into the tube is configured to have therein a bend 24. That bend at any point thereon has a radius of curvature $R_1$ of a size which may be determined by calculus methods, and which ordinarily varies from point to point. In order to avoid risk of damage to the cable, it is desirable that the size $R_1$ of the bending radius of the cable not become less than a lower limit or threshold value $R_c$ for such cable. The matter of maintaining such bending radius above such value will be later discussed in more detail.

Figure 8:
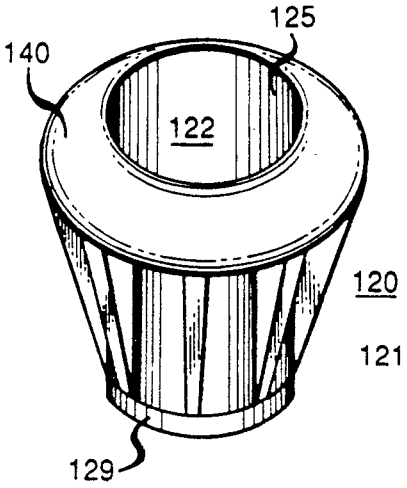
FIG. 8 is a perspective view of the mentioned cable bend reducing cap constituting an exemplary embodiment of the invention and adapted to be fitted on the FIG. 1 tube.

The coil 21 may comprise superposed layers of cable in FIG. 8 configurations in which the crossovers of the configurations in successive layers migrate around a central core for the coil. Coils of such kind are disclosed in U.S. Pat. Nos. 4,057,204 and 4,274,607.

The container 30 is in the form of a box having a square bottom and top joined by vertical rectangular side walls including a wall 31 on the right side of the box. The undeformed outer surface of wall 31 defines a plane 29. The bottom, top and side walls of box 40 are constituted of corrugated or uncorrugated cardboard or fiberboard or other packaging material adapted when constituting a portion of a wall or other panel to be resiliently flexible over a useful range of deformation.

Wall 31 has formed therein (FIG. 6) a hole 32 comprising a circular main aperture 33 and a pair of notches 34, 35 diametrically opposite each other around aperture 33 and extending radially outward from the circumference of that aperture.

The payout tube 40 is substantially the same as that disclosed in Hunt. Tube 40 comprises (FIGS. 2-5) a molded synthetic resinous tubular sleeve 41 having an axis 39 and entrance and exit ends 42, 43 for the cable 22. Located at such ends 42, 43 are back and front openings 26 and 44 for the central passage 37 through the sleeve. Disposed at the forward end 43, somewhat inward of the sleeve's exit opening 44, are two stop lugs 45, 46 integral with and disposed on diametrically opposite sides of sleeve 41 to be at opposite ends of a diameter 38 for the sleeve. The lugs 45 and 46 are, as shown, in the form of similar annular segments each having an angular extent around the sleeve of more than a quadrant but less than a semicircle. In consequence of having such disposition and form, lugs 45 and 46 are separated on transversely opposite sides of diameter 38 by the openings 47 and 48 which radially extend away from the periphery of sleeve 41 and which are notch openings in the sense that they are open to the environment of the tube at their radially outward ends. Openings 47 and 48 each provides for unblocked passage therethrough in the axial direction.

Figure 4:
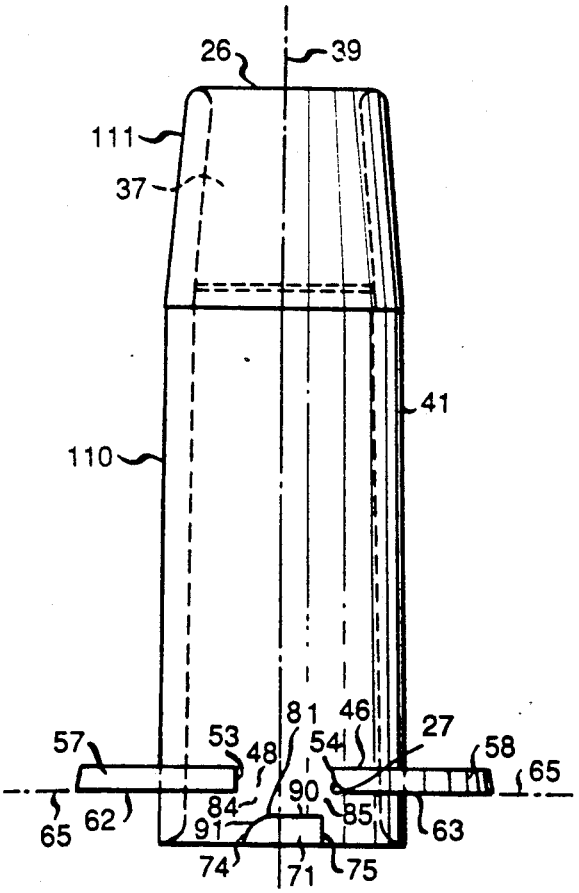
FIG. 4 is a right side elevation view of the FIG. 2 tube.
Figure 5:
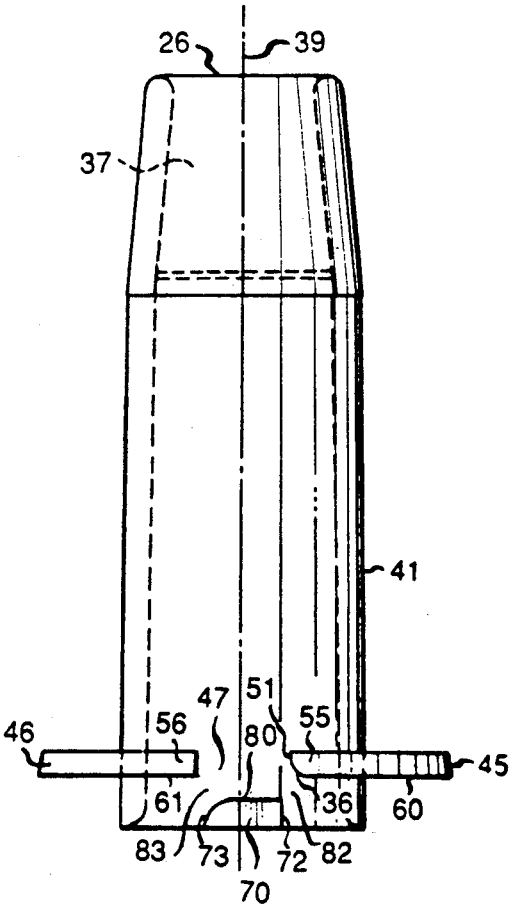
FIG. 5 is a left side elevation of the FIG. 2 tube.

Considering further details of elements 45-48, the stop lugs project radially outward from the periphery of sleeve 41 in both directions of a first dimension colinear with diameter 38 and, also, in both directions of a second dimension normal to such diameter. The notch openings 47 and 48 between the lugs are bounded on angularly opposite sides of such openings by lug margins 51, 52, 53, 54 which are normal to such diameter, i.e., are aligned with said second dimension and parallel with each other. Thus openings 47 and 48 are of constant width normal to their radial centerlines. As shown in FIGS. 4 and 5, the lug margins 51 and 54 have faired surfaces or cambers 36 and 27 on their undersides.

The lugs 45 and 46 provide on opposite sides of opening 47 a first pair of angularly adjacent stop portions 55 and 56 respective to these lugs. Similarly lugs 45 and 46 provide on opposite sides of opening 48 a second pair of stop portions 57 and 58 respective to the lugs 45 and 46. The stop portions 55-58 of tube 40 are so called because they are adapted in the use of tube 40 to bear against the inner side of box wall 31 to stop the tube from further movement outward through hole aperture 33.

The stop portions 55-58 have thereon respective surfaces 60-63 which are disposed on the axial side of such portions towards the exit opening 44 of sleeve 41,

BEND REDUCING FEED IN FOR FILAMENT PAYOUT TUBES

FIELD OF THE INVENTION

This invention relates generally to devices for dispensing a filamental article (as, say, insulated wire, stranded cable or the like) from a coil of such filament. More particularly, this invention relates to devices of such kind in which the filament is stored in a coil in turn packaged in a box or other container, and in which the dispensing device consists of a payout tube which is mostly disposed in the container but has a stub received in a hole in a wall of the container to provide a passage from its inside to its outside for filament led from the coil through the tube.

BACKGROUND OF THE INVENTION

U.S. Pat. No. 4,057,204 issued Nov. 9, 1977 in the name of R. E. Zajac to Windings, Inc. ("Zajac") discloses a payout tube of the above described sort in which an annular flange encircles the tube near its exit end to provide a planar stop surface extending continuously around the tube and the tube has at such end, outward of the flange, on diametrically opposite sides of the tube, a pair of projections which extend radially out from the tube to lie over the flange and which are shown as being of triangular cross section in planes normal to the radial center lines of the projections. The walls of such projections towards that flange are planar and slope in opposite directions as seen in a direction along the tube diameter between those center-lines.

The Zajac tube is secured in position within the container by (a) providing in a wall of the container a circular hole of the tube's diameter and having equiangularly spaced around it a pair of notches formed in the hole's circumference for receiving the tube projections, (b) positioning the tube inside the container to pass a stub portion of such tube through such hole and such projections from inside to outside through such notches until the tube flange bears against such wall around the circumferential margin of the hole, and (c) then turning the tube 90° to cause portions of the wall around the tube to be interposed between such flange and the two projections to thereby secure the tube to the wall. According to the Zajac patent as it is understood, what happens in the course of such turning is that, because the space between the flanges and the axially inner edges of the sloping projection walls towards the flange is a space less than the wall thickness of the container, the turning of the tube causes the inclined lower surfaces of the projections to ride up on the box material and grip into it to prevent accidental turning of the tube to an improper position. The Zajac patent also indicates in its abstract that improper turning of the tube is avoided because the effect of the tube projections on the box material is that the projections "dig into it".

The Zajac Tube is shown as having a cylindrical outer surface and a coaxial circular cylindrical inner surface circumferentially extending around and bounding a cylindrical bore formed in the tube and through which the cable or other filament is led. The end surface of the tube at its entrance and is a planar annular surface meeting the two mentioned cylindrical surfaces at respective circular edges which are at the radially inner and outer margins of that annular surface, and which edges are sharp. Accordingly, the Zajac tube at its entrance end has very little or nothing to inhibit the formation in cable being led through the tube of kinks and angular bends in the cable in the event the cable has to follow a curved path in the course of moving from the coil into the tube.

U.S. patent application Ser. No. 07/572812, filed Aug. 24, 1990 for "Payout Tube for Container Packaged Coiled Filament" in the name of Rodney J. Hunt, now U.S. Pat. No. 5,064,136, and assigned to the assignee hereof, and incorporated herein by reference and made a part hereof ("Hunt"), discloses a payout tube which is deemed to be an improvement over the Zajac tube in a number of respects. One of these is that the entrance end surface of the Hunt tube is shown as being a convex surface which substantially conforms to a hemi-toroidal surface produced by bisecting a torus in its center plane, and which end surface has a faired joinder at its radially inner and outer margins with the inner and outer surfaces of the tube. That rounded end surface of the Hunt tube tends to impose on the radius of curvature of bends formed in the cable in entering the tube a lower limit for such radius equal to the radius of curvature of the hemi-toroidal end surface. A difficulty, however, is that such radiis of curvature for such end surface is too small to prevent damaging bending of certain codes of cable.

As a specific example, it was desired to dispense from a box container of the sort described a quantity of a particular cable. To the end of determining if such dispensing could be satisfactorily done, a coil of such cable was placed in such a container to evaluate how well it could be pulled from the box through a Hunt tube having the rounded entrance end surface described above. It was found that the traversed layers of the cable next to the tube could not easily make the reverse bend to enter the tube without kinking the cable and sometimes tearing the jacket when sufficient force was applied to pull the cable through the tube.

SUMMARY OF THE INVENTION

The problems described above may be overcome according to the invention by a device comprising a tubular enclosure providing a wall around a passage therein for the mentioned cable, and a structure on such enclosure and furnishing at its back end a rearwardly-facing cable support surface area extending angularly around a back opening of such passage and conforming to a toroidal surface and having in radially extending planes through the axis of such tube a curvature imposing a lower limit on the bending radius of said cable when passing in contact with and over said surface area and then into said passage, such curved surface area having radially inner and outer extremities radially spaced from each other by a distance greater than the wall thickness of the enclosure at its front end. Because the extent in the radial dimension of such curved cable support surface area is not confined to such wall thickness, that curved surface may be enlarged in such dimension as much as is needed to increase its radius of curvature to the point at which the lower limit thereby imposed on the bending radius of cable entering the tube is high enough to prevent or reduce damage to the cable when it is necessarily bent in order to lead it into the tube.

Figure 9:
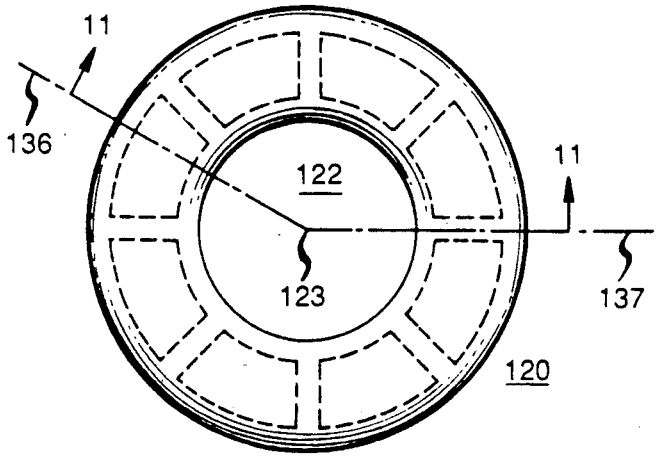
FIG. 9 is a plan view of the FIG. 8 cap.

Such device may, in one embodiment of the invention, be a cap separable from but fittable on the back end of a payout tube and adapted to reduce the sharpness of bending of cable fed into such tube at its back end. In and radially projecting outward of the cable receptacle means. Preferably but necessarily, flange 135 is in the form of a downturned lip of arcuate cross-section in planes radially passing through and containing the axis 123 as, for example, the planes 136 and 137 shown in FIG. 9 and used to take the cross-section shown in FIG. 11.

Figure 10:
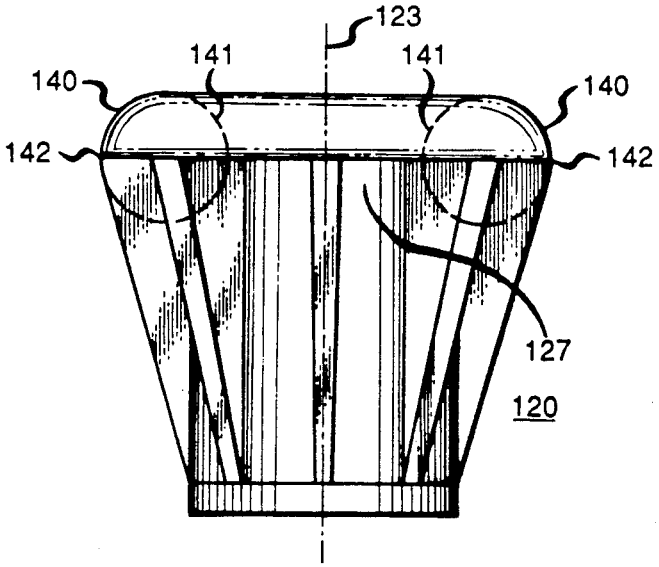
FIG. 10 is a front elevation view of the FIG. 8 cap.

The flange on lip 135 has therein a rearwardly-facing curved cable support surface 140 extending angularly around the back opening 125 for passage 122. As depicted in FIG. 10, most or all of the area of surface 140 substantially conforms in its configuration to the toroidal surface of a geometric torus 141 centered on axis 123. Torus 141 may but need not be of circular cross-section in the mentioned radial axial planes. At its upper end, the surface 140 makes a faired joinder with an annular flat 143 bordering the back opening for passage 122.

The surface 140 has a reverse curvature in the sense that, in the forward direction for the cap 120 (i.e. from its back end 127 to its front end 126), the surface does not slant radially inward towards the passage 122 but, rather, slants radially outward away from such passage. Considering its disposition and size, structure 135 permits the surface 140 to have the feature of a radially outward extremity or radially outer diameter 142 which is displaced from axis 123 by a greater radial distance than is the exterior of tubular enclosure 121 at its front end. Another feature of the curved surface 140 is that its radial extremity 142 is radially spaced in the radial axial planes of the cap 120 from the interior wall 131 of passage 122 by a distance which is greater than the wall thickness of enclosure 121 at its front end 126. Still another feature of curved surface 140 is that it has a radius of curvature $R_2$ (FIG. 12) substantially greater than the wall thickness of the enclosure 121 at its front end. All of those features distinguish the curved surface 140 from the convex entrance end surface of the Hunt tube which has been described above, and which is confined in its radial disposition and extent to lying between the inner and outer surfaces of a tube of substantially constant thickness between those surfaces.

Integrally joined with the underside of lip 135 are eight fins 145 equiangularly distributed around the main body of tubular enclosure 121 and integrally joined at their radially inner edges with that main body. In the mentioned radial-axial planes, the fins 145 are of triangular cross-section and have outer edges which slant in the forward direction radially inward from the lip 135 to vertices of the triangular fins at the skirt 129.

The fins 145 serve to strengthen and reinforce the lip 135. The same effect can be realized by "fattening" the enclosure 121 at its back end so that the exterior of its main body extends all the way out to extremity 142 and, from there, slopes in the forward direction radially inward to skirt 129. To so "fatten" the enclosure, however, has the disadvantage that it requires the incorporation in cap 120 of more plastic material than does the described fin structure and, thereby, adds to the expense of the cap while not adding any greater utility to the cap than does such fin structure.

Figure 2:
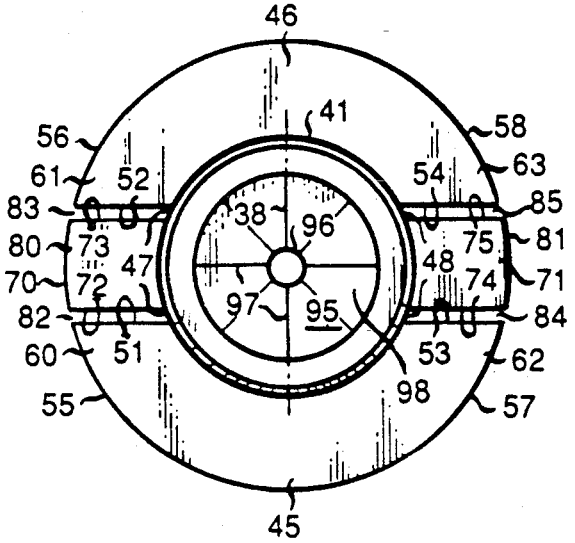
FIG. 2 is a plan view of the FIG. 1 payout tube when in upright position.
Figure 3:
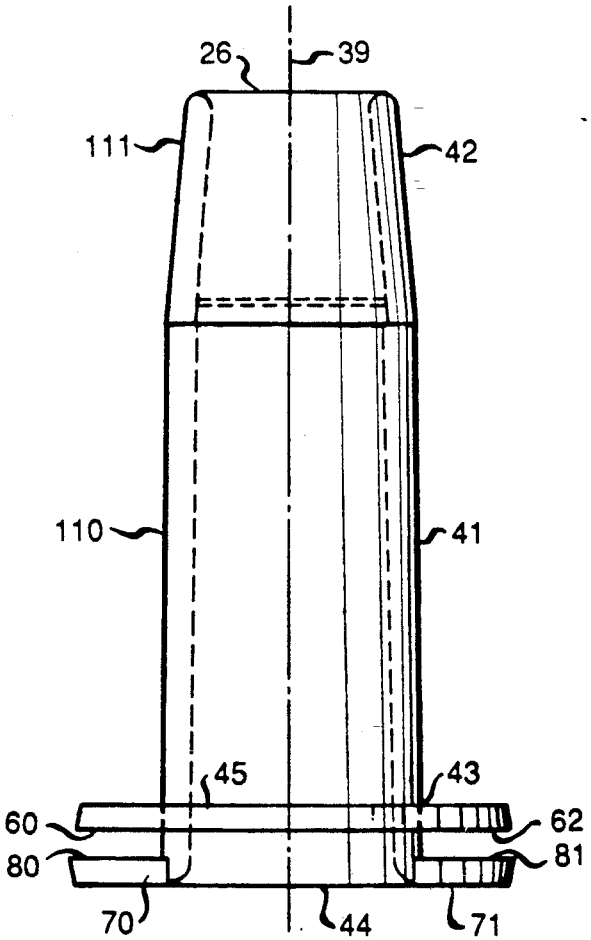
FIG. 3 is a front elevation view of the FIG. 2 tube.
Figure 12:
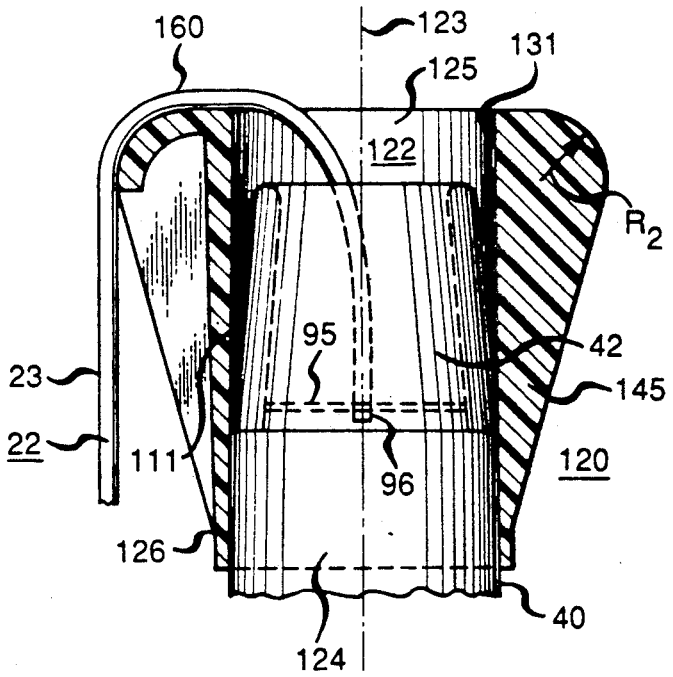
FIG. 12 is a view partly in cross section, of the FIG. 11 cap when fitted onto the rearward end of the FIG. 1 tube, such tube being broken away in FIG. 12 to show only the rearward portion of such tube, and the FIG. 12 view also depicting a length of the FIG. 1 cable being fed into the back end of the cap.

Cap 120 is used as follows. As a preliminary, the cap is placed in the container 30 within which the tube 40 has been secured as earlier described (FIG. 2). Then the front end 126 of the cap is, as shown in FIG. 12, fitted onto the entrance or rearward end 42 of the tube 40 so that the interior frustro-conical surface 131 in the passage 122 of the cap is slipped over and into contact with the frustro-conical surface 111 on the exterior of the rearward end of the tube. The two surfaces have the same angle of taper so to make flush contact with each other. By virtue of such flush contact, the cap and tube are coupled together by a joint which permits their relative rotation, but which is inflexible in that it keeps the cap and tube angularly fixed in relative position in the radial axial planes 136, 137 and other such planes.

With cap 120 being so fitted on tube 40 within container 30, the cable 22 is led from its coil 21 over the curved cable support surface 140 (at the back end 127 of the cap) and into the back opening 125 of the passage 122 through the cap for the cable. Thereafter, cable 22 is led into the entrance end of the passage 47 through the tube 40, then through the aperture 96 in the diaphragm 95 in that passage, and, finally, out of the exit end of tube 40 to the outside of container 30 (FIG. 1). The cap 120 and the tube 40 thus provides a common conduit for the passage of the cable from inside to outside the container.

It often happens that, in leading cable 22 from its coil into the back opening in cap 120, the cable has formed therein a curvature 160 (FIG. 12) constituting a reverse bend in the sense that, proceeding in the direction along cable 22 from its coil 21 to its free end, the curvature first extends in the rearward axial direction and then curves around to end up extending in the forward axial direction. Such a reverse bend is to be distinguished from a forward bend within which progress along the cable in the direction from its coil to its free end is always in the forward axial direction of cap 120 and tube 40.

In the case of such a reverse bend formed in cable 22, if the radius of curvature $R_1$ of the cable within the bend is shrunk in size to become less than a critical threshold value $R_c$ for such cable, the cable 22 will tend to kink and to consequently sustain damage to materials of the cable. The cable support surface 140 is however constructed so that its radius of curvature $R_2$ is greater than such critical radius $R_c$. Accordingly, as the cable length 23 is, in the course of entering the cap passage 120, passed over the cable support surface 140 to be in contact therewith along the extent over which such curved surface and the cable path register with each other in their common radial-axial plane, such surface will, by virtue of having its radius $R_2$ greater than $R_c$, serve by its cable supporting and guiding action to prevent or greatly reduce the occurrence of any such kinking or damage. More particularly and as specifically shown in FIG. 12, at all points in the mentioned extent along which the cable passes over and in contact with the curved surface 140 of the cap 120, the cable at any such point has a bending radius which is equal to, and cannot be less than, the radius of curvature at any such point of the surface 140. In those circumstances, accordingly, the curvature of surface 140 imposes at any such point, on the bending radius of the cable, a lower limit equal to the radius of curvature at such point of that surface. If such radius of curvature of such surface is the same at all such points, then such lower limit at all such points is equal to that constant radius of curvature. If, on the other hand, the radius of curvature of surface 140 varies over the mentioned extent, then the lower limit in such circumstances is the minimum radius of curvature of surface 140 within such extent.

Such contact between the cable and surface 140 over such extent is ordinarily maintained while dispensing cable from container 30 by the outward pulling force and which surfaces (or parts thereof) lie in and define a plane 65 (FIG. 4) normal to the axis 39 of the sleeve.

Those surfaces (or parts thereof) are adapted to bear against the inner side of wall 31 to stop tube 40 as described above. For convenience, such surfaces are referred to herein as "stop surfaces" although such nomenclature does not necessarily mean that all areas of such surfaces lie in plane 65 or perform the stopping function just mentioned.

Besides the radial projections provided on sleeve 41 by lugs 45 and 46, the sleeve has thereon two additional projections in the form of locking tabs 70 and 71 disposed to be at angular positions corresponding to those of openings 47 and 48 and intermediate those of, respectively, the stop portions 55, 56 and the stop portions 57, 58. The tabs 70 and 71 are coupled and integral with sleeve 41 and project away from it in radially opposite directions. Tab 70 has angularly opposite margins 72, 73 adjacent and parallel to the margins 51, 52 on the lugs 45 and 46 while tab 71 has angularly opposite margins 74, 75 adjacent and parallel to the margins 53, 54 on those lugs.

In the axial direction, the tabs 70 and 71 are disposed on Sleeve 41 outward of the lugs 45 and 46 to be axially opposite the interlug openings 47, 48, but the tabs are not further out than the sleeve's exit opening 44. The tabs have thereon respective guide surfaces 80 and 81 facing in the axial direction towards the entrance end of the sleeve and axially displaced from the plane 65. The guide surface 80 of tab 70 is separated by gaps 82 and 83 from, respectively, the stop surface 60 on lug 45 and the stop surface 61 on lug 46. Similarly the guide surface 81 on tab 71 is separated by gaps 84 and 85 from, respectively, the stop surface 62 on lug 45 and the stop surface 63 on lug 46.

The guide surface 81 on tab 71 (FIG. 4) consists for the most part of a flat land 90 lying parallel to plane 65. That surface also includes, however, at the left hand margin 74 of tab 71 a rounded surface area 91 providing at that margin a camber for tab 71. The guide surface 80 of tab 70 is similarly shaped (FIG. 5) to consist for the most part of a flat land parallel to plane 65 but to include also at its margin 73 a rounded surface area providing at such margin a camber for tab 70.

The interior of sleeve 41 contains at the sleeves entrance end 42 a diaphragm 95 (FIG. 2) integral with the sleeve and extending across such interior. The diaphragm is perforated at its center by an axial aperture 96 of slightly smaller diameter than filament 22 and at the center of a "star" configuration formed of a plurality of slits 97 equiangularly distributed around hole 96 and radially extending outward from it. The slits 97 divide the area of diaphragm 95 adjacent aperture 96 into resiliently deflectable fingers 98.

Tube 41 over most of its length from its front to its back end has an exterior surface 110 which is close to being circular cylindrical, but which in fact, is a frustro-conical surface tapering convergently rearward with a very small angle of taper. Above the section occupied by surface 110, the tube has another section of which the exterior is in the form of another frustro-conical surface 111 tapering convergently rearward with a greater angle of taper than that characterizing surface 110. Such second tapered surface is not present in the tube disclosed by Hunt.

Figure 6:
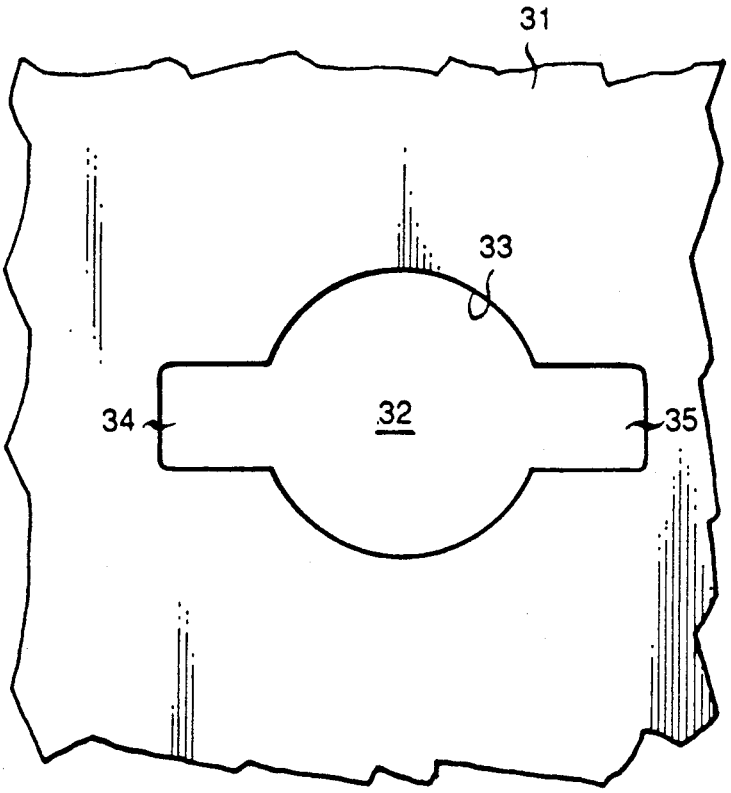
FIG. 6 is a fragmentary right side elevation view of the FIG. 1 container showing an outlet hole made in a wall of such container for the payout tube shown in FIGS. 1-5.
Figure 7:
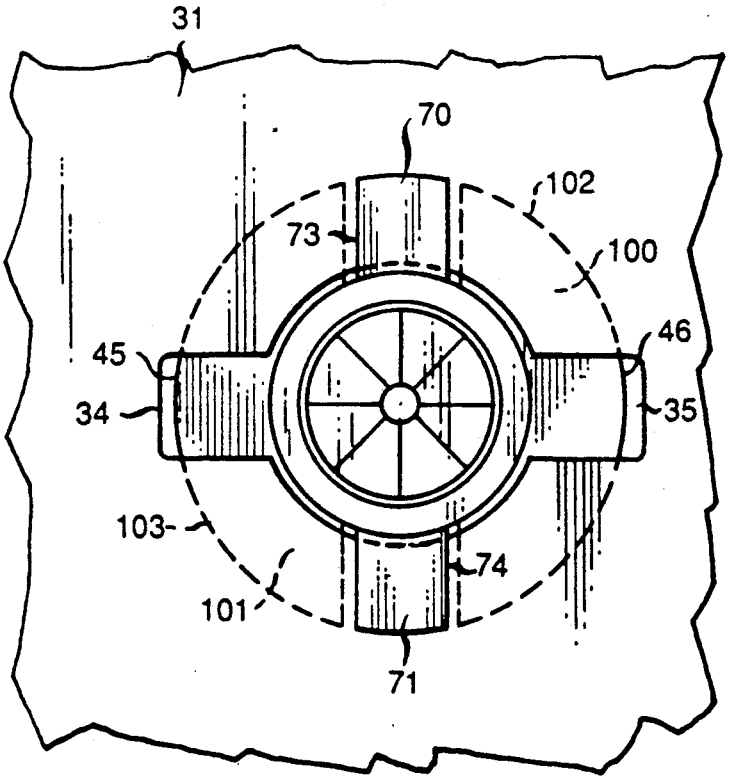
FIG. 7 is a view of the mentioned hole similar to that of FIG. 6 but showing in addition the mentioned tube of FIGS. 1-5 after it has been inserted into and then turned 90° in the FIG. 6 hole.

The manner in which payout tube 41 is secured to container 30 is shown by FIGS. 6–7 and is as follows. With the tube being in the container, the tube is axially aligned with aperture 32 in the container's wall 31 and is then rotated about its axis to bring the tube tab 71 into angular alignment with the notch 34 of the hole 32 through container wall 31, the camber 91 on the tab being on its downside when the tube is so angularly aligned. The tube is then advanced towards container wall 31 to pass such tab through such notch and to pass tab 70 through notch 35. The advance in that direction of the tube is stopped by the coming into contact of the stop surfaces 60–63 on the tube's stop lugs 45, 46 with the inside surface of the box wall 31.

Having thus passed the locking tabs 70 and 71 of tube 40 to the outside of box wall 31 and produced engagement between the stop surfaces of that tube and the inside of such wall, the tube is next turned counterclockwise (FIG. 7) about its axis through an angular arc which ultimately reaches 90°. At the beginning of the turning, the cambers on the tabs 70 and 71 engage the adjacent margins of the notches 35 and 34 to deflect inwards (i.e., towards the center of box 30) two sections 100 and 101 of box wall 31 which border hole 32, and the areas occupied by which are indicated very approximately in FIG. 7 by the dash lines 102 and 103.

In response to such turning of the tube, the wall section 100 is deformed to pass under stop lug 46 (FIG. 5), through gap 83, past locking tab 70, through gap 82 and then under stop lug 45 to be gripped between the stop lugs 46, 45 and the locking tab 70. Similarly in response to such turning, the wall section 101 is curved to pass under stop lug 45 (FIG. 4), through gap 84, past locking tab 71, through gap 85 and then under stop lug 46 to be gripped between the latter stop lugs and locking tab. In this way, the payout tube 40 is secured to the wall 31 of container 30 to be held within such container in the position for the tube shown in FIG. 1.

Turning now to FIGS. 8–11, the reference numeral 120 designates a bend reducing cable feed-in cap for the tube 40. Cap 120 is a synthetic resinous molded article comprising cable receptacle means in the form of a tubular enclosure 121 having therein a passage 122 having an axis 123 and extending through the enclosure between front and back openings 124 and 125 for the passage. These openings 124 and 125 are at, respectively, the front end 126 and the back end 127 of the enclosure 121. The main body of the enclosure provides around the passage 122 a circumferential bounding wall of which the exterior consists for the most part of a surface 128 which extends from the back end of element 121 almost to its front end, and which is a frustro-conical surface 128 tapering convergently in the forward direction with a slight taper angle. At, however, its front end 126, the enclosure terminates in a short skirt 129 having an exterior circular cylindrical surface.

The convergently tapering surface 128 on the outside of enclosure 121 is matched on its inside by a surface 131 which circumferentially bounds the passage 122, and which is a frustro-conical surface extending from the back end of enclosure 121 to its skirt 129 and tapering divergently in the forward direction with a slight angle of taper. Within the skirt 129, the circumferential bounding surface of passage 122 is circular-cylindrical.

Figure 11:
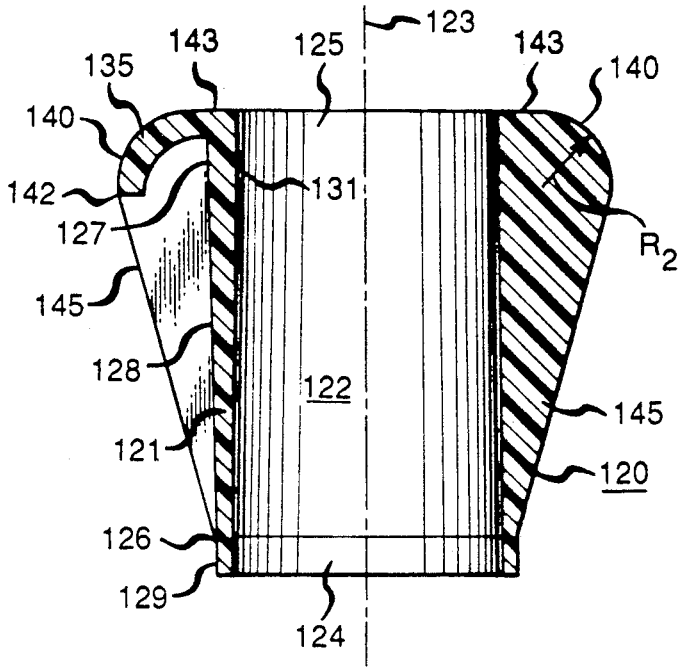
FIG. 11 is a view in vertical cross-section, taken as indicated by the arrows 11—11 in FIG. 9 of the FIG. 8 cap.

The cap 120 further comprises cable feed-in guide means in the form of structure 135 providing at the back end of tubular enclosure 121 and in the radial dimension an enlargement of the cap relative to its size in such dimension at the front end of the enclosure. As shown in FIG. 11 such structure may be an annular flange 135 integral with enclosure 121 angularly extending around exerted outside the container on the cable in order to draw it out. Thus, the use of cap 120 permits the storing in and dispensing from box containers like container 30 cable which could not otherwise be so stored and dispensed because of the likelihood of damage being done thereto in the course of dispensing.

As examples in point and utilizing box containers with coils of cable and payout tubes in the container as depicted in FIG. 1, four boxes of cable were prepared equipping the tubes therein with a cap providing a curved bend-reducing cable support surface similar to the described surface 140, and the cable was then pulled from such boxes. The cables were all put up in 1000 foot lengths, and the entire contents of each box was pulled. All of such cable were of a type as to likely kink and become damaged in the course of being dispensed if such a cable support surface had not been provided therefor. There were, however, in the case of the cables just mentioned, no instances of cable kinking or cable jacket tears using the subject cap.

Figure 13:
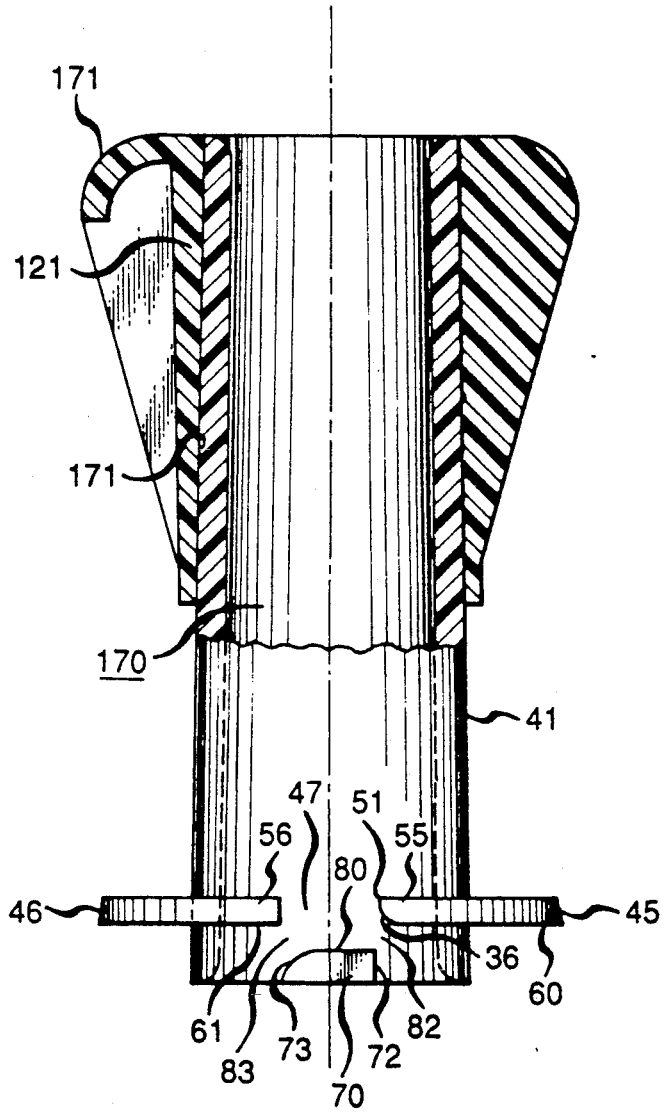
FIG. 13 is a front elevation view of an additional exemplary embodiment of the invention, such additional embodiment consisting of the FIG. 1 tube as modified at its back and to incorporate features of the FIG. 8 cap.

An advantage of having the described bend-reducing cable support surface provided by a cap fittable on the payout tube is that, when the cable to be dispensed from the container is of a type in which undue cable bending and consequent cable damage is not a problem in dispensing the cable, the cap need not be used and the costs of fabricating the cap and of providing its plastic material are thereby avoided. Alternatively, however, the described bend-reducing cable support surface may be incorporated into the payout tube as a permanent and integral feature thereof to increase the versatility of the tube in that the tube becomes suited for use as a dispenser both when the cable is of the type just mentioned or when the cable is of a type in which undue cable bending and consequent cable damage would be a problem in dispensing the cable. To effect such incorporation of that support surface into the payout tube as such a permanent and integral feature thereof, the separate tube 40 and cap 120 shown in FIG. 12 may be fused together to provide the payout tube 170 shown in FIG. 13. When element 40 and 120 are so fused, the tubular sleeve 41 of tube 40 and the tubular enclosure 121 of tubular sleeve 41 of cap 120 are integrally joined together to form a tubular member 171. The tube 170 except at its rearward has the same features as the payout tube shown in FIGS. 2–5. At its rearward end, however, the tube 170 is modified to incorporate a bend-reducing cable support surface 171 substantially the same as the surface 140 of like function of cap 120, and to incorporate, also, other features which will be recognized from the showing of FIG. 12 as being taken from such cap.

The above described embodiments being exemplary only, it is to be understood that additions, thereto, omissions therefrom and modifications thereof can be made without departing from the spirit of the invention. For example, the cable bend-reducing cap may be coupled to the payout tube by a fitting provided by having a circular cylindrical socket formed within the passage of the cap at its front end and to the rear thereof, and by having the exterior of the payout tube shaped at its rearward end to form a circular cylindrical plug receivable with a snug fit within such socket. As another example, the cable support surface 140 may be modified from the configuration shown herein so as to have a radially outward surface area of reverse curvature joined in a faired manner with a radially inward surface area having a forward curvature in the sense that, within such area, the surface slants in the axially forward direction radially inward towards the axis 123 of the passage 122 in the cap. Such a support surface would have a configuration somewhat similar to the already described entrance end surface of the Hunt tube, but would be much greater in radial extent.

Accordingly, the invention is not to be considered save as is consonant with the recitals of the following claims.

I claim:

1. A cap for a payout tube having forward and rearward ends and adapted when in a container for cable to project at its forward end through a hole in a wall of such container, and to lead cable through such tube from inside to outside said container, said cap comprising; cable receptacle means having therein a passage having an axis and extending through such means between back and front openings for such passage at back and front ends, respectively, of such means, said front end being fittable with said rearward end of said tube to provide a common conduit through said cap and tube for said cable, and said cap further comprising cable feed-in guide means extending angularly around said back opening to provide therearound a rearwardly-facing curved cable support surface area conforming to a toroidal surface, and having in planes radially passing through and containing said axis a curvature with a radius of curvature imposing a lower limit, equal to said radius of curvature, on the bending radius of said cable when passing in contact with and over said support surface area and then into said passage.

2. A cap according to claim 1 in which said curvature in said planes of said support surface area comprises a reverse curvature for which the slope of the curve slants forwardly in the radial direction away from said passage.

3. A cap according to claim 1 in which said cable feed-in guide means comprises a radial enlargement of the back end of said receptacle means relative to the front end thereof.

4. A cap according to claim 1 in which said cable feed-in guide means comprises an annular flange angularly extending around, and radially projecting outward of, said receptacle means, and providing said support surface on the back side of said flange.

5. A cap according to claim 4 in which said receptacle means comprises a main body constituting a tubular enclosure for said passage, and said cap further comprises a plurality of axially extending fins angularly spaced around said enclosure and joined with the main body thereof and with the front side of said flange to reinforce said flange.

6. A cap according to claim 5 in which said cap is a synthetic-resinous molded article, and in which said tubular enclosure, flange and fins are integral with each other.

7. A cap according to claim 4 in which said flange is in the form of a down-turned curved lip extending around said back opening and of arcuate cross-section in such planes.

8. A cap for a payout tube having forward and rearward ends and adapted when in a container for cable to project at its forward end through a hole in a wall in such container, and to lead cable through such tube from inside to outside said container, said cap comprising, a tubular enclosure providing a wall around a passage therein for said cable, said passage having an axis and extending through such enclosure between back and front openings for said passage at back and front ends, respectively of such enclosure, said front end being fittable with said rearward end of said tube to provide a common conduit through said cap and tube for said cable, and said cap further comprising a structure on said enclosure furnishing at the back end of said enclosure a rearwardly-facing curved cable support surface area extending angularly around said back opening and conforming to a toroidal surface and having in planes radially passing through and containing said axis a curvature with a radius of curvature imposing a lower limit, equal to said radius of curvature, on the bending radius of said cable when passing in contact with and over said support surface area and then into said passage.

9. A cap according to claim 8 in which said curved surface area has a radially outward extremity and is displaced at such extremity from said axis by a greater distance than is the exterior of said enclosure at its front end.

10. A cap according to claim 8 in which the radial distance in said planes between the radially outward extremity of said curved surface area and said wall around said passage is greater than the wall thickness of said enclosure at its front end.

11. A device primarily adapted to be disposed in a container having therein a coil of cable and, when in such container, to guide said cable in a path passing from within said container through a hole in a wall of such container and to the outside of said container, said device comprising, a tubular enclosure providing a wall around a passage therein for such cable, such passage having an axis and extending through such enclosure between back and front openings of said passage at back and front ends, respectively, of such enclosure, and said device further comprising a structure on said enclosure which furnishes at its back end a rearwardly-facing curved cable support surface area extending angularly around said back opening of said passage and conforming to a toroidal surface and having in planes radially passing through and containing said axis a curvature with a radius of curvature imposing a lower limit, equal to said radius of a curvature, on the bending radius of said cable when passing in contact with and over said surface area and then into said passage, said curved surface area having a radially outer extremity radially spaced in said planes from said wall around said passage by a distance greater than the wall thickness of said enclosure at its front end.

12. A payout tube primarily adapted to be disposed in a container having therein a coil of cable and, when in such container, to project at one end thereof through a hole in a wall of such container, and to guide said cable in a path extending through such tube and hole to the outside of said container, said tube comprising; a tubular member providing a wall around a passage therein for said cable, such passage having an axis and extending through such member between back and front openings for said passage at back and front ends, respectively, of such member, means at the front end of said member to secure it to said container wall when said member is positioned within said container to have such front end project through said hole, and said tube further comprising a structure on said member which furnishes at its back end a rearwardly-facing curved cable support surface area extending angularly around said back opening of said passage and conforming to a toroidal surface and having in planes radially passing through and containing said axis a curvature with a radius of curvature imposing a lower limit, equal to said radius of curvature on the bending radius of said cable when passing in contact with and over said surface area and then into said passage, said curved surface area having a radially and outer extremity radially spaced in said planes from said wall around said passage by a distance greater than the wall thickness of said member at its front end.

* * * * *